US007534980B2

(12) United States Patent
Wilgen et al.

(10) Patent No.: US 7,534,980 B2
(45) Date of Patent: May 19, 2009

(54) HIGH MAGNETIC FIELD OHMICALLY DECOUPLED NON-CONTACT TECHNOLOGY

(75) Inventors: John Wilgen, Oak Ridge, TN (US); Roger Kisner, Knoxville, TN (US); Gerard Ludtka, Oak Ridge, TN (US); Gail Ludtka, Oak Ridge, TN (US); Roger Jaramillo, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 120 days.

(21) Appl. No.: 11/393,378

(22) Filed: Mar. 30, 2006

(65) Prior Publication Data

US 2007/0235445 A1 Oct. 11, 2007

(51) Int. Cl.
*H05B 6/10* (2006.01)

(52) U.S. Cl. ..... 219/635; 219/600

(58) Field of Classification Search ..... 219/635, 219/600, 679, 660, 621, 603; 428/339, 412, 428/402; 156/272.4, 272.2, 275.5; 324/207.17
See application file for complete search history.

(56) References Cited

U.S. PATENT DOCUMENTS 6,469,919 B1 * 10/2002 Bennett ..... 363/56.02
6,762,600 B2 * 7/2004 Khalfin ..... 324/207.17
7,161,124 B2 * 1/2007 Kisner et al. ..... 219/635

OTHER PUBLICATIONS

G. I. Eskin, "Broad prospects for commercial application of the ultrasonic (cavitation) melt treatment of light alloys," Ultrasonics Sonochemistry 8 (2001) pp. 319-325.

(Continued)

*Primary Examiner*—Quang T Van
(74) *Attorney, Agent, or Firm*—Brinks Hofer Gilson & Lione

(57) ABSTRACT

Methods and apparatus are described for high magnetic field ohmically decoupled non-contact treatment of conductive materials in a high magnetic field. A method includes applying a high magnetic field to at least a portion of a conductive material; and applying an inductive magnetic field to at least a fraction of the conductive material to induce a surface current within the fraction of the conductive material, the surface current generating a substantially bi-directional force that defines a vibration. The high magnetic field and the inductive magnetic field are substantially confocal, the fraction of the conductive material is located within the portion of the conductive material and ohmic heating from the surface current is ohmically decoupled from the vibration. An apparatus includes a high magnetic field coil defining an applied high magnetic field; an inductive magnetic field coil coupled to the high magnetic field coil, the inductive magnetic field coil defining an applied inductive magnetic field; and a processing zone located within both the applied high magnetic field and the applied inductive magnetic field. The high magnetic field and the inductive magnetic field are substantially confocal, and ohmic heating of a conductive material located in the processing zone is ohmically decoupled from a vibration of the conductive material.

25 Claims, 9 Drawing Sheets

OTHER PUBLICATIONS

Charles Vives, "Effects of Forced Electromagnetic Vibration during the Solidification of Aluminum Alloys: Part I. Solidification in the Presence of Crossed Alternating Electric Fields and Stationary Magnetic Fields," Metallurgica and Materials Transactions B, 27B (1996) pp. 445-455.

Charles Vives, "Effects of Forced Electromagnetic Vibration during the Solidification of Aluminum Alloys: Part II. Solidification in the Presence of Colinear Variable and Stationary Magnetic Fields," Metallurgica and Materials Transactions B, 27B (1996) pp. 457-464.

O. V. Abramov, "Action of high intensity ultrasound on solidifying metal," Ultrasonics, 25 (1987) pp. 73-82.

J. Campbell on "Effects of vibration during solidification" International Metals Reviews, 2 (1981) pp. 71-108.

S. Makarov, R. Ludwig, and D. Apelian, "Resonant oscillation of a liquid metal column driven by electromagnetic Lorentz force sources," J. Acoust. Soc. Am. 105 (1999) 2216-24.

G.M. Ludtka, et. al., "In-situ Evidence of Enhanced Phase Transformation Kinetics Due to a High Magnetic Field in a Medium Carbon Steel,", *Scripta Materialia*, 51 (2004) 171-174.

R. A. Jaramillo, S. S. Babu, G. M. Ludtka, R. A. Kisner, J. B. Wilgen, G. Mackiewicz-Ludtka, D. M. Nicholson, S. M. Kelly, M. Murugananth, and H. K. D. H. Bhadeshia, "Effect of 30 Tesla Magnetic Field on Transformations in a Novel Bainitic Steel", *Scripta Materialia*, 52 (2005) 461-466.

* cited by examiner

AL2-NF10-1
OT, 10 psi
12/8/2005

AL2-18T40-1NF10-1
40 psi
12/6/2005

06-0069-06 BOTTOM A356 Al 2-NF-10-1 EMAT – 200μm 06-0069-02 TOP A356 Al 2-NF-10-1 EMAT – 200μm 06-0069-08 BOTTOM A356 Al 2-NF-10-1 EMAT – 20μm 06-0069-04 TOP A356 Al 2-NF-10-1 EMAT – 20μm 06-0073-06 BOTTOM A356 Al 2-9T-40-1 EMAT – 200μm 06-0073-02 TOP A356 Al 2-9T-40-1 EMAT – 200μm 06-0073-08 BOTTOM A356 Al 2-9T-40-1 EMAT – 20μm 06-0073-04 TOP A356 Al 2-9T-40-1 EMAT – 20μm 06-0058-08 BOTTOM AL-18T-40-1 EMAT UN-MOUNTED ~ 200μm 06-0058-04 TOP AL-18T-40-1 EMAT UN-MOUNTED ~ 200μm 06-0058-10 BOTTOM AL-18T-40-1 EMAT UN-MOUNTED ~ 20μm 06-0058-06 TOP AL-18T-40-1 EMAT UN-MOUNTED ~ 20μm

HIGH MAGNETIC FIELD OHMICALLY DECOUPLED NON-CONTACT TECHNOLOGY

STATEMENT AS TO RIGHTS TO INVENTIONS MADE UNDER FEDERALLY-SPONSORED RESEARCH OR DEVELOPMENT

This invention was made with United States Government support under prime contract No. DE-AC05-00OR22725 to UT-Battelle, L.L.C. awarded by the Department of Energy. The Government has certain rights in this invention.

BACKGROUND INFORMATION

1. Field of the Invention

Embodiments of the invention relate generally to the field of high magnetic field ohmically decoupled non-contact technology. More particularly, some embodiments of the invention relate to methods and apparatus for ohmically decoupled non-contact ultrasonic treatment of conductive materials via inductively induced surface current(s) in a static high magnetic field.

2. Discussion of the Related Art

Ultrasonic processing of materials in both the melt and solid phase is proving to be highly beneficial to material properties of metallic alloys. In the melt phase, acoustic treatment can be used to enhance diffusion, dispersion, and dissolution processes, resulting in improvements in the cleaning, refining, degassing, and solidification of the melt. Ultrasonic processing can be used to assist in grain refinement and to minimize segregation during solidification. Degassing with ultrasonics has resulted in reduced gas concentration, higher density, and improved mechanical properties. It has been demonstrated that non-dendritic structures can be produced with ultrasonic cavitation treatment, resulting in increased plasticity and enhanced strength. In the solid state phase, ultrasonic treatment could potentially be utilized to minimize residual stress, accelerate phase transformation processes, enhance nucleation and growth during phase transformations, enhance diffusive processes by enhancing the mobility of diffusing species, and enhance processes that have a threshold activation energy.

Commercially available ultrasonic processing systems require direct contact with the melt, resulting in undesirable chemical interactions when the acoustic probe/horn is inserted directly into the molten material or in direct contact with the containment vessel such as a crucible or mold. Ultrasonic transducers are limited in temperature range, and therefore must be thermally isolated from high-temperature environments through the use of an acoustical waveguide, or horn. Acoustic impedance mismatches between the transducer and the waveguide, as well as between the waveguide and the melt can limit the transfer of energy. Various types of probe coatings have been investigated in an effort to minimize the chemical interactions of the probe surface with the melt. In addition, the localized nature of the horn probe results in a very non-uniform distribution of acoustical energy within the melt crucible.

What is needed is a solution that (preferably simultaneously) solves the above described problems.

SUMMARY OF THE INVENTION

There is a need for the following embodiments of the invention. Of course, the invention isnot limited to these embodiments.

According to an embodiment of the invention, a process comprises: applying a high magnetic field to at least a portion of a conductive material; and applying an inductive magnetic field to at least a fraction of the conductive material to induce a surface current within the fraction of the conductive material, the surface current generating a substantially bi-directional force that defines a vibration, characterized in that i) the high magnetic field and the inductive magnetic field are substantially confocal, ii) the fraction of the conductive material is located within the portion of the conductive material and iii) ohmic heating from the surface current is ohmically decoupled from the vibration. According to another embodiment of the invention, a machine comprises: a high magnetic field coil defining an applied high magnetic field; an inductive magnetic field coil coupled to the high magnetic field coil, the inductive magnetic field coil defining an applied inductive magnetic field; and a processing zone located within both the applied high magnetic field and the applied inductive magnetic field, characterized in that i) the high magnetic field and the inductive magnetic field are substantially confocal, and ii) ohmic heating of a conductive material located in the processing zone is ohmically decoupled from a vibration of the conductive material.

These, and other, embodiments of the invention will be better appreciated and understood when considered in conjunction with the following description and the accompanying drawings. It should be understood, however, that the following description, while indicating various embodiments of the invention and numerous specific details thereof, is given for the purpose of illustration and does not imply limitation. Many substitutions, modifications, additions and/or rearrangements may be made within the scope of an embodiment of the invention without departing from the spirit thereof, and embodiments of the invention include all such substitutions, modifications, additions and/or rearrangements.

BRIEF DESCRIPTION OF THE DRAWINGS

The drawings accompanying and forming part of this specification are included to depict certain embodiments of the invention. A clearer concept of embodiments of the invention, and of components combinable with embodiments of the invention, and operation of systems provided with embodiments of the invention, will be readily apparent by referring to the exemplary, and therefore nonlimiting, embodiments illustrated in the drawings (wherein identical reference numerals (if they occur in more than one view) designate the same elements). Embodiments of the invention may be better understood by reference to one or more of these drawings in combination with the following description presented herein. It should be noted that the features illustrated in the drawings are not necessarily drawn to scale.

DESCRIPTION OF PREFERRED EMBODIMENTS

Figure 1:
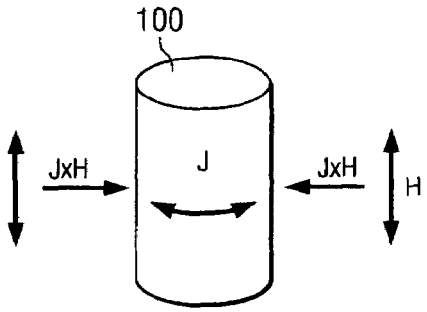
FIG. 1 (PRIOR ART)
FIG. 1 is a schematic perspective view of the origin of the electromagnetic acoustical transducer (EMAT) effect that is intrinsic to induction heating, appropriately labeled "prior art."

Embodiments of the invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the embodiments of the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Within this application several publications are referenced by Arabic numerals, or principal author's name followed by year of publication, within parentheses or brackets. Full citations for these, and other, publications may be found at the end of the specification immediately preceding the claims after the section heading References. The disclosures of all these publications in their entireties are hereby expressly incorporated by reference herein for the purpose of indicating the background of embodiments of the invention and illustrating the state of the art.

The invention can include non-contact ultrasonic treatment of metals via induction heating in a high magnetic field. This method can be combined with other high-field magnetic processing of materials, but can be used to advantage in circumstances where only high intensity ultrasonic treatment is beneficial. A specific advantage of this method is that the ultrasonic energy is coupled directly to the sample, and no direct contact is required. The ability to couple acoustic energy directly via a non-contacting method overcomes a huge technological barrier to the more widespread use of ultrasonic processing. The invention can include a superior ultrasonic processing method for producing enhanced material properties in metallic alloys.

The invention can include a synergistic combination of high surface current density (induced via induction heating) in a high-field magnet, which is a very effective method for creating a high energy density acoustic environment. This provides a non-contact method for applying high-intensity ultrasonic energy to the processing of metals. Furthermore, the applied ultrasonic excitation can be uniformly distributed over most of the surface of the metal sample.

Using this method, non-contacting ultrasonic treatment can be applied to the processing of metal alloys in the solid and/or melt phase(s). Molten metals can be contained in a non-metallic ceramic crucible of a type that is readily penetrated by the induction heating fields. Ultrasonic treatment in the solid phase can be achieved either at near-ambient temperatures, or at elevated temperature. When applied under high temperature conditions, temperature control can readily be achieved via the induction heating process, whereas at ambient temperatures, active cooling would be required to remove the heat deposited by the inductive heating system.

A method is described for non-contact ultrasonic treatment of metals via induction heating in a high magnetic field. The method can be coupled with high-field magnetic processing of materials, but can also be used to advantage in circumstances where only high intensity ultrasonic treatment is beneficial. A specific advantage of the method is that the ultrasonic energy is coupled directly to the sample, and no direct contact is required. Generally this approach eliminates the elevated temperature problems associated with the use of the more conventional probe/horn ultrasonic applicator.

In the discussion that follows, the high intensity EMAT effect created by induction heating in a high-field magnet is described in greater detail. The amplitude of the resulting ultrasonic excitation is compared with the much weaker EMAT effect that is intrinsic to all induction heating systems. The latter effect is discussed first.

Without High Magnetic Field

Referring to FIG. 1, the current in an induction heating coil creates a magnetic H-field consistent with the boundary condition, $H_{tan}=J_{coil}$, where $J_{coil}$ is the current density in the coil. For a heating coil geometry including a 6-turn coil with a length of 24 mm, and a peak coil current of 140 amps, the average current density is given by $J_{coil}=6(140/24))=35$ A/mm, which is equivalent to 35 kA/m in mks units. The resulting axially directed H-field in the interior of the induction heating coil is approximately $H_z=35{,}000$ A/m. When a solid cylindrical sample 100 is placed within the induction coil, the magnetic field will induce an azimuthally-directly current on the surface of the sample, with magnitude given by $J_\theta=H_z=35$ kA/m. To first order, the current density induced on the sample is equal to the current density of the induction heating coil, $J_{coil}$. The depth to which the induced current penetrates the sample is determined by the classical skin depth.

The surface current, $J_\theta$, as it flows perpendicularly to the axial magnetic field, experiences a force $-J\times B$ that acts on the surface of the sample, as shown in FIG. 1. This force, or pressure, is directed inward, in the negative radial direction (in cylindrical coordinates). Because the surface current changes polarity whenever the H-field changes polarity, the resulting force is always in the same direction. Since the B-field is $B_z=\mu_0 H_z=(4\pi\times10^{-7})(35\text{ kA/m})=0.044$ Tesla, the magnitude of the pressure is given by $F_r=J_\theta\times B_z=(35\text{ kA/m})(0.044\text{ T})=1540\text{ N/m}^2=1540$ Pa.

If the time dependence of the induction field is given by $H_z=H_o\sin(2\pi ft)$ where f=300 kHz and $H_o=35$ kA/m, then the induced surface current density is given by $J_\theta=H_o\sin(2\pi ft)$. In this case, the time dependence of the radial force (i.e., pressure) is given by $F_r=-\mu_o(H_0)^2\sin^2(2\pi ft)$. Note that the pressure does not reverse direction, and is always directed inward (i.e., in the −r direction). From the trigonometric identity $2\sin^2\times=1-\cos(2\times)$, it can be seen that the pressure includes two contributions, 1) a time-averaged component given by $-(1/2)\mu_o(H_o)^2$, and an oscillatory component, $(1/2)\mu_o(H_o)^2\cos(4\pi ft)$, of the same amplitude that oscillates at twice the induction heating frequency, i.e., at a frequency of 600 kHz. [Note that the pressure can equivalently be attributed to the discontinuity in the energy density (or pressure) of the magnetic field, $\mu_o H_o^2$, at the surface of the conductor, due to the fact that the magnetic field is excluded from the metal by the skin effect.]

In summary, induction heating by itself results in the direct application of an oscillatory pressure to the heated surface at an ultrasonic frequency that is twice the induction heating frequency. This is essentially an electromagnetic acoustical transducer (EMAT), and this rather weak effect is intrinsic to the induction heating process. If the surface current density in the heating coil is 35 kA/m, then the pressure amplitude is about 750 Pa, which is 1500 Pa peak-to-peak, or about $1/60^{th}$ of atmospheric pressure. For other values of surface current density, the pressure varies as the square of the current density.

With High Magnetic Field

Figure 2:
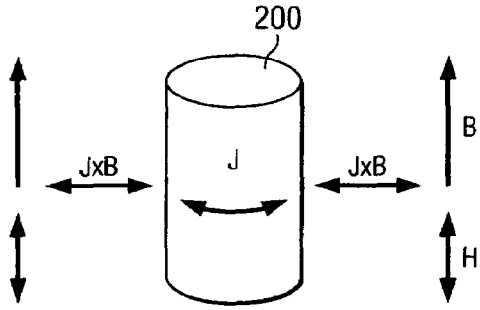
FIG. 2 is a schematic perspective view of induction heating in a high-field magnet (the H-field of the induction heating coil is insignificant ($\mu_0 H << B$) compared to the static 30 Tesla B-field of a high-field magnet), representing an embodiment of the invention.

Referring to FIG. 2, when induction heating is applied in a high magnetic field environment, and the static magnetic field is aligned with the axis of the induction heating coil, then the electromagnetic force (and resulting ultrasonic EMAT output) is greatly enhanced. If the axis of the induction heating coil is aligned with the static magnetic field of a high-field magnet, the azimuthally-directed surface current induced in the process metal interacts with the static field of the magnet. The result is a large oscillatory electromagnetic force, or pressure, that acts directly on the metal surface, at the induction heating frequency. In cylindrical coordinates, the force is in the radial direction. FIG. 2 illustrates induction heating in a high-field magnet, showing the applied H-field of the induction coil, the induced azimuthally-directed surface current (J), the static magnetic field (B) and the resulting electromagnetic force (J×B). The H-field of the induction heating coil is insignificant ($\mu_0 H << B$) by comparison with the large static B-field of a superconducting magnet (9 Tesla for example). It is important to understand that the acoustic driving force is bi-directional, alternately compressing and stretching (tensioning) the sample 200. In liquids, the later leads to cavitation, which can be very beneficial for ultrasonic processing of the melt phase. The acoustic pressure can be quite substantial since both the induced surface current and the static magnetic field are large.

For the previous induction heating example, the B-field produced by the induction current density of 35 kA/m was just 0.044 Tesla. When induction heating is performed inside a high-field magnet, as shown in FIG. 2, using a static magnetic field of 30 Tesla, then the static magnetic field exceeds the induction-heating self-field by roughly a factor of 700. In this case, only the static field need be considered when estimating the acoustic amplitude, as the induction self-field is insignificant.

In this case, the magnet field strength has a constant value of $B_z$=30 T, while the induced surface current density is the same as for the previous example, as give by $J_\theta=H_o\sin(2\pi ft)$. The time dependence of the radial force (i.e., pressure) is then given by $F_r=J_\theta\times B_z=H_oB_z\sin(2\pi ft)$, which alternates in direction whenever the surface current changes direction (i.e., at the induction heating frequency). The magnitude (amplitude) of the pressure is given by $F_r=J_\theta\times B_z$=(35 kA/m)(30 T)=1,050,000 nt/m$^2$=1.05 MPa, or 2 MPa peak-to-peak. To put this in perspective, note that this amplitude is approximately twice the pressure amplitude needed to produce cavitation in molten metals depending on the gas content of the melt.

In summary, induction heating in a high-field magnet greatly enhances the acoustic stimulation of the heated surface, and does so at an ultrasonic frequency that is exactly equal to the induction heating frequency. The acoustic driving force is bi-directional, alternatively compressing and stretching the sample. In liquids, the later leads to cavitation, which can be very beneficial for ultrasonic processing of the melt phase. Note that the static field provided by the high-field magnet greatly enhances the efficiency of the EMAT (electromagnetic acoustical transducer). For the specific example given, the amplitude of the acoustic pressure generated by induction heating within the high-field magnetic is at least 1000 times greater than the pressure generated by the intrinsic self-field of the induction heating by itself. If the surface current density of the heating coil is 35 kA/m, in a 30 T magnet, then the resulting acoustic pressure amplitude is 1 MPa, or about 10 atmospheres. For other values of induced surface current density, the pressure amplitude varies just linearly with the current density.

Resonance, Experimental Results, Feedback and Alternative Embodiments

The effectiveness of acoustical excitation can be greatly enhanced if the frequency happens to coincide with a natural resonant frequency of the sample. Because of the large mismatch in the acoustic impedance at a material-air interface, most of the acoustic energy will be trapped within the sample and the sample container, forming an acoustical resonator. If the acoustic drive frequency is chosen to match a natural resonant frequency of the sample/holder, then the peak acoustic pressure in the resonator is enhanced by a factor that is equal to the quality factor of the resonator. Quality factors for liquid metal columns with large length-to-diameter ratios are expected to be in the range of 10-100. Although a somewhat smaller quality factor might be expected for the proposed experimental configuration, due consideration will be given to take advantage of acoustical resonances.

Figure 7:
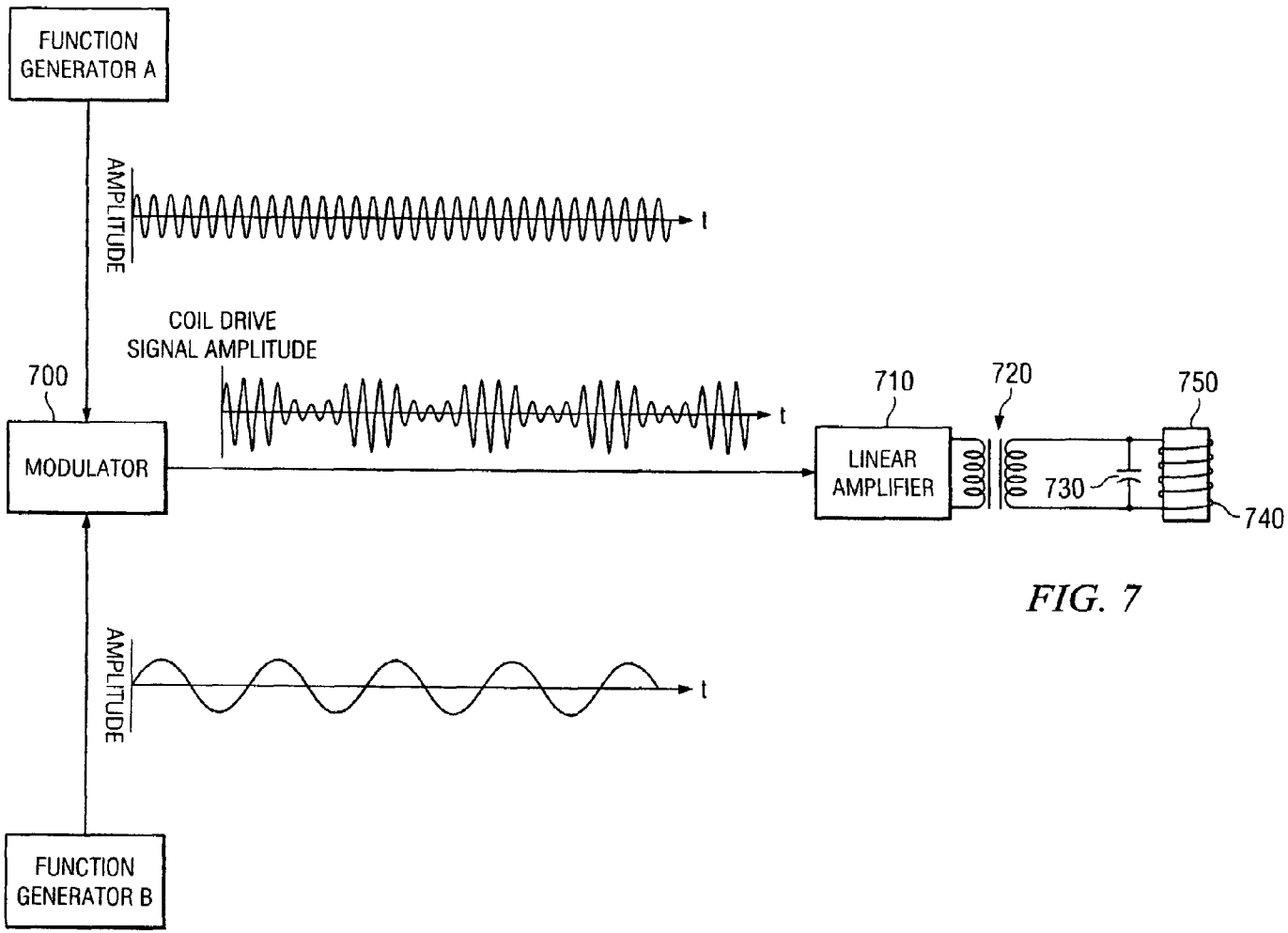
FIG. 7 is a block schematic view of an apparatus, representing an embodiment of the invention.

Referring to FIG. 7, electrical resonance of the induction coil and acoustic resonance of the work piece may not share the same frequencies. For single coil applications, a modulated carrier waveform can be used to apply two frequencies simultaneously as shown in FIG. 7A. Function generator A is coupled to a modulator 700. A function generator B is also coupled to the modulator 700. The modulator 700 is coupled to a linear amplifier 710. The linear amplifier 710 is coupled to an impedance matching transformer 720. The impedance matching transformer 720 is coupled to a capacitor 730 and an induction heating coil 740 surrounding a work piece 750. The carrier corresponds to the electrical resonance of the induction coil; the modulation frequency corresponds to the ultrasonic resonance of the work piece. In this way ultrasonic stimulation can be achieved with variety of coil sizes and resonant frequencies.

Figure 8A:
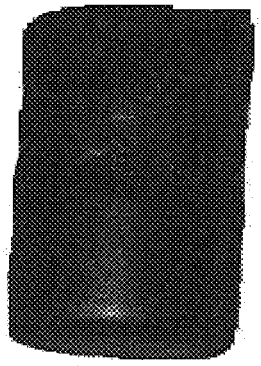
FIGS. 8A and 8B are photographic views of a comparative sample (8A) and a sample (8B) processed in a high magnetic field, representing an embodiment of the invention.
Figure 8B:
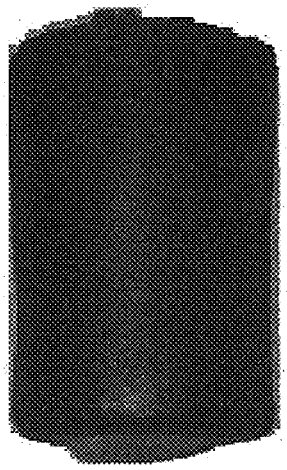
Figure 9A:
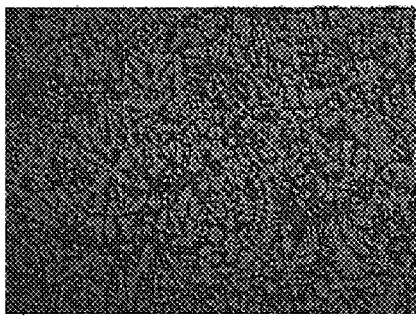
FIGS. 9A-9D are micrograph views of the bottom (9A & 9C) and the top (9B & 9D) of a comparative sample, representing an embodiment of the invention.
Figure 9B:
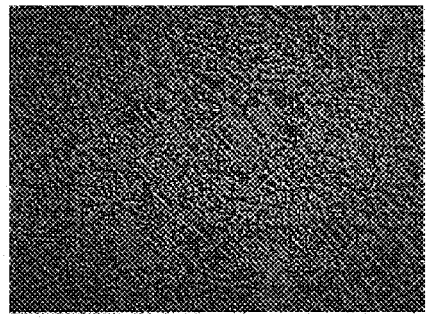
Figure 9C:
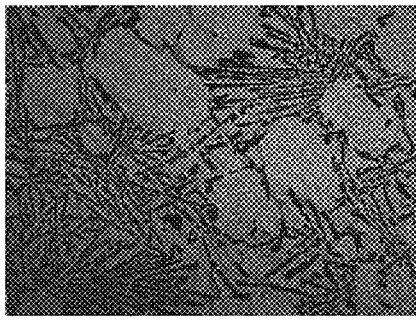
Figure 9D:
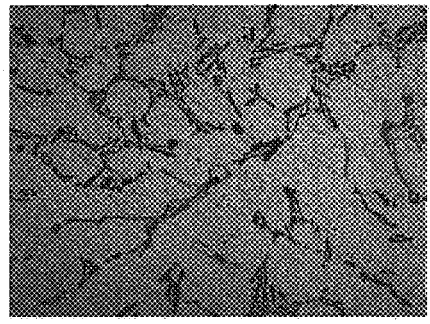
Figure 10A:
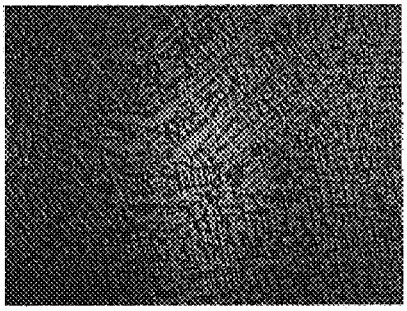
FIGS. 10A-10D are micrograph views of the bottom (10A & 10C) and the top (10B & 10D) of a sample processed in a 9 Tesla high magnetic field, representing an embodiment of the invention.
Figure 10B:
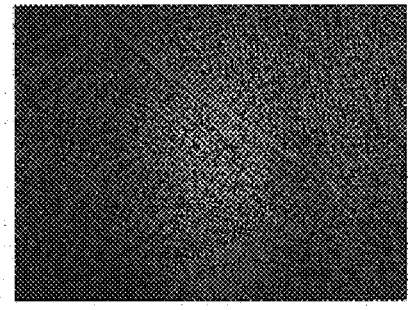
Figure 10C:
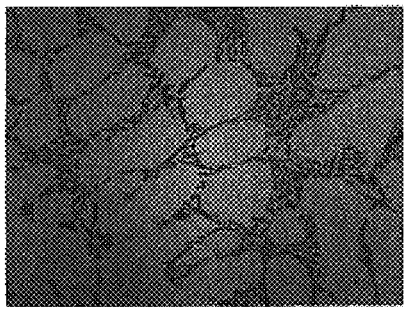
Figure 10D:
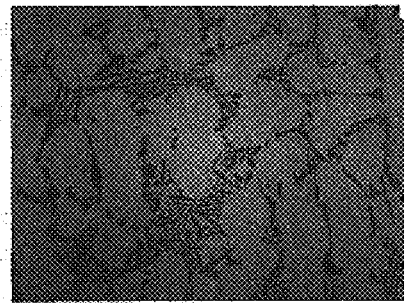
Figure 11A:
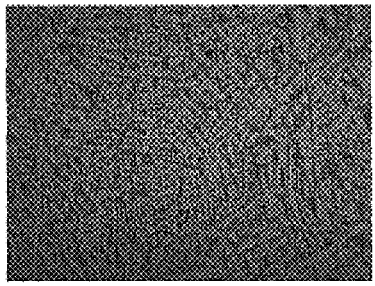
FIGS. 11A-11D are micrograph views of the bottom (11A & 11C) and the top (11B & 11D) of a sample processed in a 18 Tesla high magnetic field, representing an embodiment of the invention.
Figure 11B:
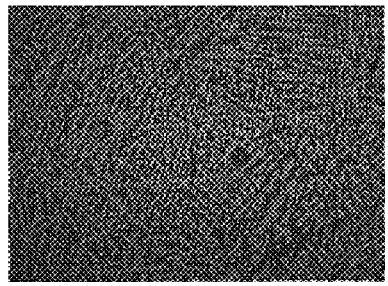
Figure 11C:
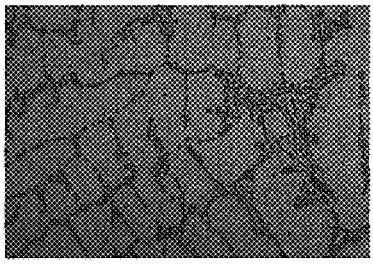
Figure 11D:
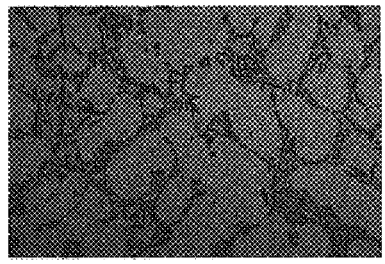

Referring to FIGS. 8A-8B, experimental results show improved ingot surface appearance with test conditions including an 18 T high magnetic field (FIG. 8B) compared to test conditions including no magnetic field (FIG. 8A). Referring to FIGS. 9A-9D, test conditions including no magnetic field exhibits significant variation in microstructure from top to bottom in a cast A356 aluminum ingot suggesting segregation and in-homogeneity issues. Referring to FIGS. 10A-10D, test conditions including a 9 Tesla magnetic field yielded comparable microstructures for the top and bottom of a cast A356 aluminum ingot supporting an improved homogeneity hypothesis predicated on a reduction/elimination of segregation issues. Referring to FIGS. 11A-11D, test conditions including an 18 Tesla magnetic field yielded further comparable microstructures for the top and bottom of a cast A356 aluminum ingot again supporting an improved homogeneity hypothesis predicated on the reduction/elimination of segregation issues.

The invention can include feedback control of frequencies. The control of frequencies for induction heating carrier and for ultrasonic modulation may be configured as a part of a feedback control system so that those frequencies track shifts in resonance due to thermal effects and mechanical changes.

For the large external field, preferred embodiments of the invention include a substantially static (e.g., homogeneous) magnetic field. Alternative embodiments of the invention can include a large magnetic field generated and applied by an alternating current source or by a large single (or multiple) magnetic pulse. (Pulsed magnets at the National High Magnetic Field Laboratory at Los Alamos National Laboratory (LANL) are capable of up to 100 T.) For pulse durations long enough to include a significant number of ultrasonic cycles, the magnetically enhanced EMAT effect can produce enormously intense ultrasonic compression. Similarly, an alternating high magnetic field can also be used with an induction heating source to produce intense ultrasonic energy. The most likely uses of an alternating B-field would be for reasons other than an ultrasonic effect; however, ultrasonic processing using the enhanced J×B forces could be effectively used with an alternating field. The J×B forces would be calculated in the same way as static systems only the B-field would be time varying.

Preferred embodiment of the invention include a configuration of the work piece and an induction coil immersed inside a large static magnet field from a solenoid-type magnet. Naturally, in this case the "work piece" (such as a casting) would be inside the bore of the magnet either with the induction coil surrounding the work piece or inside of it. Alternative embodiments of the invention can include the magnet, work piece, and induction coil configured in reverse order, i.e., a large magnet is surrounded by the work piece and the induction coil is either between the work piece and the magnet or surrounds the work piece. This system configuration could be used for processing inside a large diameter tube for example. The J×B forces would be calculated the same as other systems although the B-field might not be as intense as inside the magnet's bore. Generically, the inter-relationship of the fields in these configurations can be termed confocal.

EXAMPLES

Specific embodiments of the invention will now be further described by the following, nonlimiting examples which will serve to illustrate in some detail various features. The following examples are included to facilitate an understanding of ways in which an embodiment of the invention may be practiced. It should be appreciated that the examples which follow represent embodiments discovered to function well in the practice of the invention, and thus can be considered to constitute preferred mode(s) for the practice of the embodiments of the invention. However, it should be appreciated that many changes can be made in the exemplary embodiments which are disclosed while still obtaining like or similar result without departing from the spirit and scope of an embodiment of the invention. Accordingly, the examples should not be construed as limiting the scope of the invention.

Example 1

Figure 3:
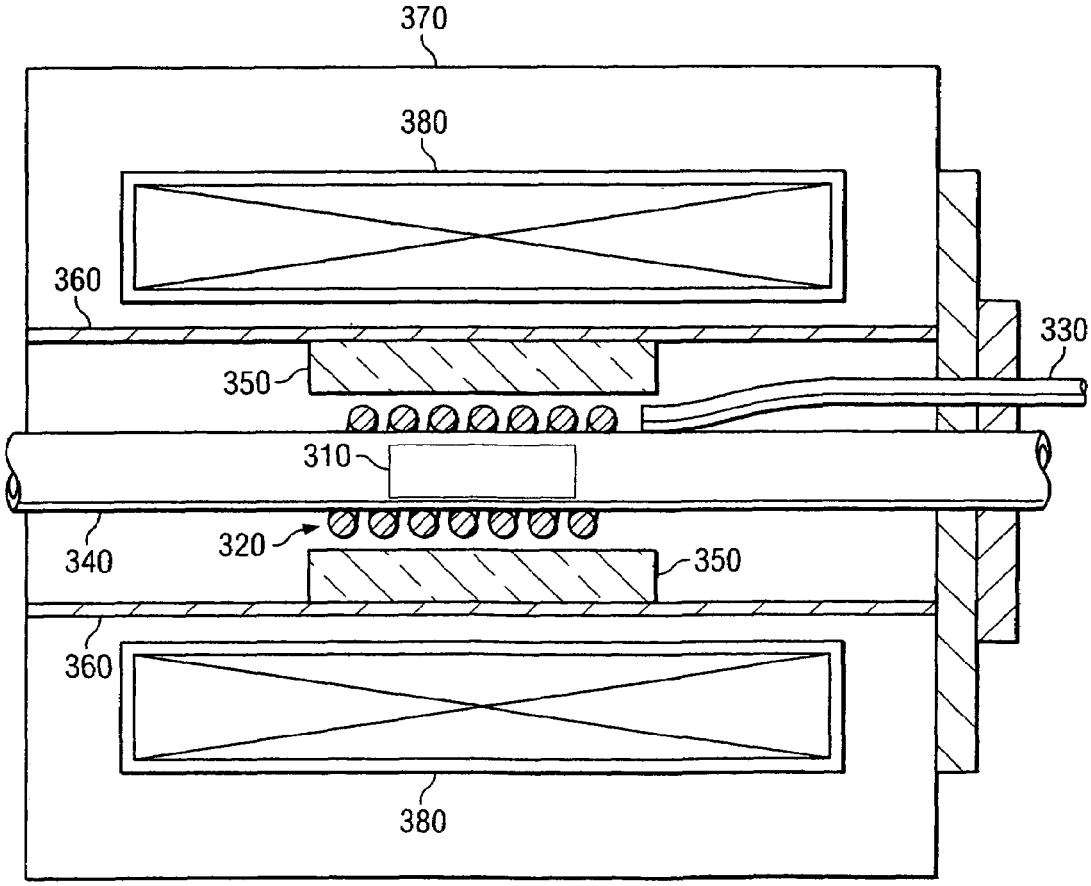
FIG. 3 is a view of an apparatus, representing an embodiment of the invention.

An embodiment of a non-contact, ultrasonic, ohmically decoupled insert inside a nine Tesla superconducting magnet is shown in FIG. 3. The work piece 310 is shown inside a single induction coil 320. The coil 320 includes a single layer of water-cooled copper tubing. Power is fed to the coil by way of a coaxial transmission line 330. The work piece 310 is electrically and thermally insulated from the induction coil 320 by a quartz tube 340. Ceramic spacers 350 support the induction coil against electromagnetic forces. An actively cooled conductive lining 360 is placed between the induction coil and the bore of the cryostat to prevent heat loading of the cryogenic system 370 of the superconducting magnet 380. Some electromagnetic energy is deposited in the lining. This particular embodiment includes a superconducting magnet including of niobium-titanium conductors that are readily commercially supplied by American Magnetics, Inc.

Example 2

Figure 4:
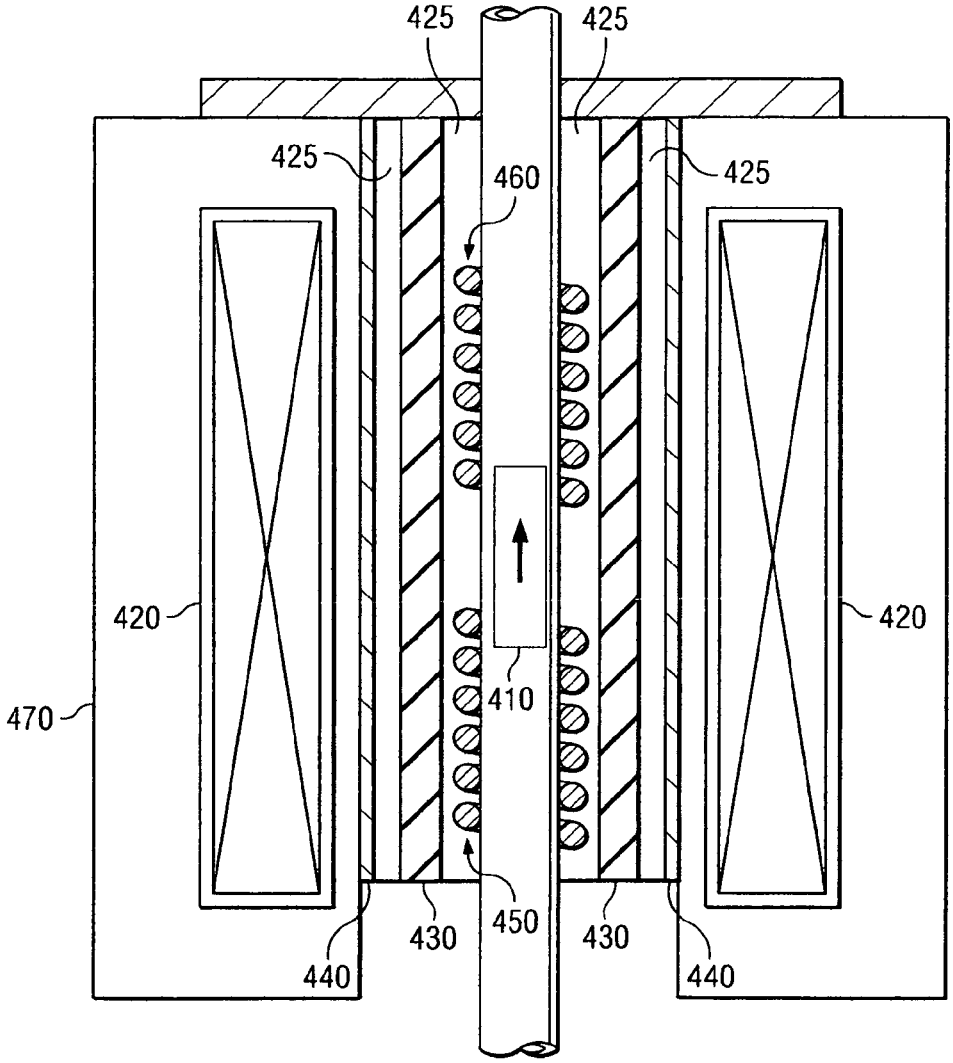
FIG. 4 is a view of an apparatus, representing an embodiment of the invention.

An embodiment for continuous work piece processing is shown in FIG. 4. A continuous work piece 410 passes coaxially through a super conducting solenoid magnet assembly 420. This embodiment also illustrates a dual coil configuration. One coil 450 is optimized for inductive heating of the work piece. The other coil 460 is optimized for application of ultrasonic excitation. Thermal insulation 430 is used to minimize the heat load on the superconducting magnet's cryostat 470. There are spaces 425 for cooling gases between the work piece 410 and the thermal insulation 430 and also between the thermal insulation 430 and a conductive electromagnetic barrier 440.

Example 3

Figure 5:
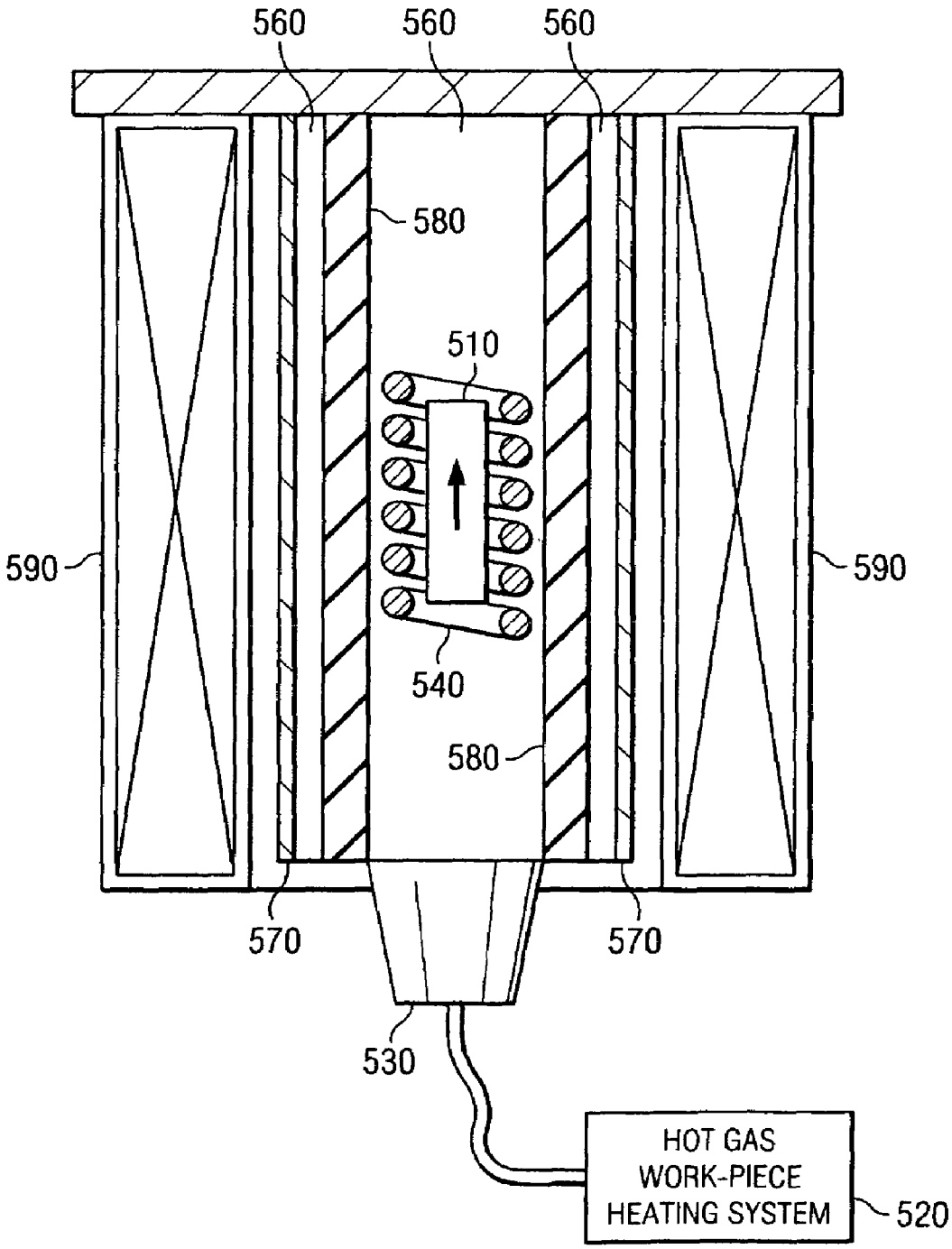
FIG. 5 is a view of an apparatus, representing an embodiment of the invention.

An embodiment is shown in FIG. 5 that heats a work piece 510 by a heated gas from a hot gas work piece heating system 520 via a gas distribution nozzle 530 while ultrasonic energy is applied through an induction coil 540 that is water or gas cooled. This embodiment illustrates another method of separating heating and ultrasonic processing functions. Thermal insulation 580 is used to minimize the heat load on the magnet 590. There are spaces 560 for cooling gases between the work piece 510 and the thermal insulation 580 and also between the thermal insulation 580 and a conductive electromagnetic barrier 570.

Example 4

Figure 6:
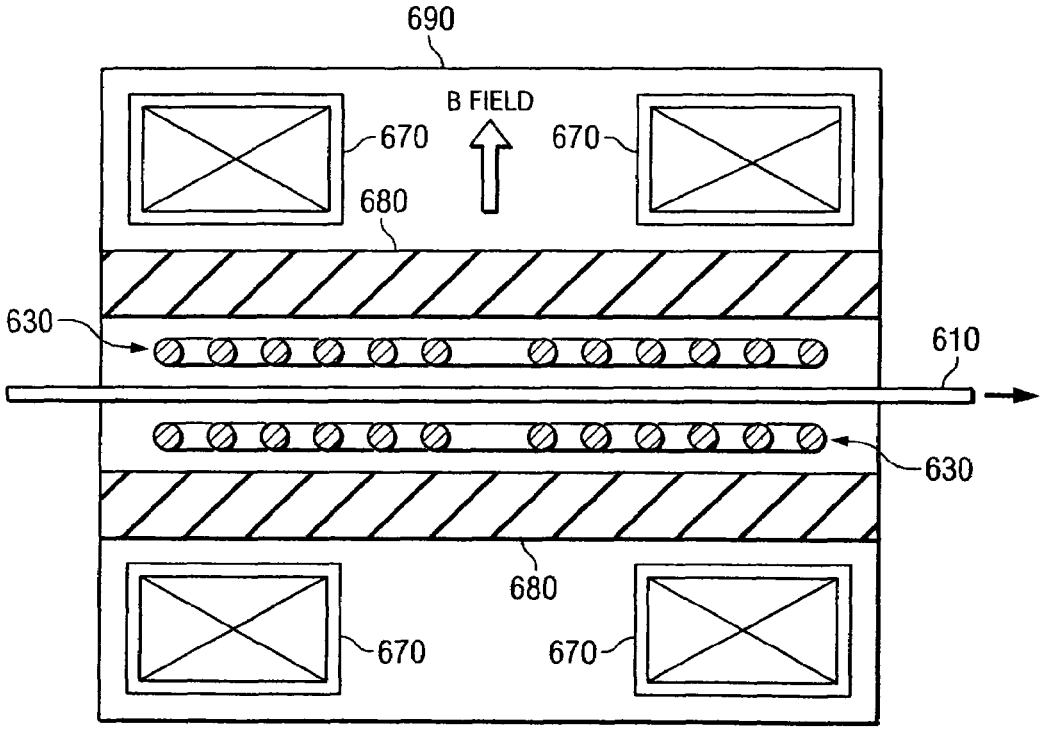
FIG. 6 is a view of an apparatus, representing an embodiment of the invention.

An embodiment is shown in FIG. 6 that permits continuous ultrasonic processing of sheet 610 material (transverse mode). Dual pancake coils are employed for independent heating 620 and ultrasonic processing 630. Electromagnetic coupling between the two coils 610, 620 is substantially reduced by positioning them on opposite sides of the electrically conducting metal sheet 610. Access to the magnetic fields is maximized by using a split Helmholtz coil configuration 670. Thermal insulation 680 is used to minimize the heat load on the superconducting magnet's cryostat 690.

Practical Applications

A practical application of an embodiment of the invention that has value within the technological arts can be melt degassing prior to or during solidifications processes (this has significant ramifications for aluminum alloys). A practical application of the invention can be grain refinement (via enhanced nucleation, growth, and fragmentation processes) during solidification. A practical application of the invention can be reduction or elimination of macro- and micro-segregation during solidification. (i.e., development of more homogeneous microstructures by reducing or eliminating coring and banding during solidification). A practical application of the invention can be enhanced nucleation and growth during fusion (solidification) and solid-state phase transformations. A practical application of the invention can be development of more equiaxed microstructures that are less dendritic. A practical application of the invention can be refinement of inclusion particle size for a given volume fraction of impurities (inclusions) to improve performance as smaller particles initiate fracture by void initiation and coalescence at higher strains than larger inclusions. A practical application of the invention can be reduction of grain refining alloy additions (such as titanium diboride in aluminum alloys) by ultrasonically enhancing grain refinement resulting in production cost reduction. A practical application of the invention can be residual stress reduction or elimination. A practical application of the invention can be fatigue life enhancement. A practical application of the invention can be enhanced metal deformation processing as a result of a more homogeneous microstructure. A practical application of the invention can be ultrasonic atomization processing to produce uniform powders (via liquid microdroplets) for powder metallurgy applications or flame spraying coating processes. A practical application of the invention can be enhancement of catalytic reactions as ultrasonic irradiation can increase reactivities by nearly a million-fold (through the process of acoustic cavitation since during bubble collapsing phase intense heating of the bubbles occurs which can increase the local temperature and pressure significantly). A practical application of the invention can be production of more homogeneous aluminum alloys with low solubility (1-3%) and low melting (Pb, Bi, Sn, etc.) alloy additions for the purpose of enhancing machinability (this can be accomplished by the emulsification and dispersion of these elements in the molten alloy. A practical application of the invention can be enhanced semi-solid (thixotropic or rheocast alloy processing) deformation processing by producing more equiaxed semi-solid microstructures that can be shape cast or forged into components requiring higher strains than possible with irregular semi-solid microstructures. The more equiaxed microstructure will facilitate using lower deformation loads for a given amount of strain. A practical application of the invention can be production of hypereutectic Al—Si alloys which normally contain coarse primary silicon particles by ultrasonically facilitating the development of fine primary silicon particles which in turn increases the plasticity of the cast metal and allows for ingot deformation using conventional deformation processing equipment and techniques. A practical application of the invention can be the adoption of ultrasonic processing approaches for grain refinement during continuous casting (e.g., for bar & rod or strip production) or shape casting (e.g., die casting, semi-solid melt forging) operations as no probe needs to be in contact directly with the melt or crucible/mold. A practical application of the invention can be elimination of retained austenite by ultrasonically eliminating (or enhancing mobility of) defect structures that pin phase transformation front interfaces. A practical application of the invention can be enhancement of diffusion processes by locally enhancing the mobility of diffusing species. A practical application of the invention can be coupling with magnetic processing to amplify the high magnetic field processing effects such as accelerated transformation kinetics or development of metastable microstructures for enhanced performance. A practical application of the invention can be accelerating phase transformation processes such as the aging process of precipitation hardening alloys (e.g., Al, Ti, Ni, Fe, Mg alloys) or the tempering of ferrous materials. A practical application of the invention can be modification of the volume fractions of the various constituents in the microstructure evolving during phase decomposition (e.g., the volume fraction of austenite in a steel during elevated temperature processing). A practical application of the invention can be enhancement of general processes that have any threshold activation energy. A practical application of the invention can be enhanced activation of carbon nanotube precursor materials containing appropriate catalysts for the formation and growth of desired nanostructures such as single walled (SWNT) and multi-walled (MWNT) carbon nanotubes, especially when the induction field is preferentially activating in some manner [e.g., locally higher temperatures] relative to one or some of a set of constituents (e.g., the catalyst particle(s) in the nanotube precursor material(s)). The invention can be utilized in conjunction with magnetic processing to amplify the high magnetic field processing effects such as accelerated transformation kinetics or development of metastable microstructures for enhanced performance. There are virtually innumerable uses for embodiments of the invention, all of which need not be detailed here.

Advantages

Embodiments of the non-contact process invention include at least the followings benefits over conventional contact ultrasonic processing methods for both the melt-phase and also the solid-state phase. Embodiments of the invention obviate the need for the utilization of some form of probe or horn that has the precise length measurements (usually determined experimentally and needs to be some multiple of one-half wavelength) at the specific temperature of use to produce the acoustic waves associated with conventional contact processing. Embodiments of the invention obviate the material compatibility/corrosion problems involved with the use of conventional contact processing in the context of molten metal applications which limits the survivability and usefulness of the transducer/horn. Contact methods using these probes/horns have a temperature gradient that can be a function of time that makes it extremely difficult to achieve an appropriate length ultrasonic wave in the probe/horn. Embodiments of the invention can substantially eliminate the elevated temperature problems associated with the probe/horn. Embodiments of the invention improve quality and/or reduce costs compared to previous approaches.

Definitions

The phrase high magnetic field is intended to mean a magnetic field greater than or equal to 1 Tesla (e.g., 2 T, 3 T, 4 T, 5 T, 6 T, 7 T, 8 T, 9 T, 10 T, . . . , 30 T, 31 T, 32 T, 33T, etc.). The phrase bi-directional vibration is intended to mean oscillatory motion along two directions of an axis, the difference in magnitudes of which are less than or equal to 10% (e.g., 9%, 8%, 7%, 6%, 5%, 4%, 3%, 2%, 1%, . . . , 0.4%, 0.3%, 0.2%, 0.1% etc.) of one another. The phrase ohmically decoupled is intended to mean that a decrease in induced surface current due to a decrease in inductive coil current can be compensated for (traded off), with respect to vibration, with an increase in a static magnetic field while ohmic heating from the induced surface current is reduced as the square of the decreased inductive coil current. The term program and/or the phrase computer program are intended to mean a sequence of instructions designed for execution on a computer system (e.g., a program and/or computer program, may include a subroutine, a function, a procedure, an object method, an object implementation, an executable application, an applet, a servlet, a source code, an object code, a shared library/dynamic load library and/or other sequence of instructions designed for execution on a computer or computer system). The phrase ultrasonic frequency is intended to mean frequencies greater than or equal to approximately 10 KHz. The phrase radio frequency is intended to mean frequencies less than or equal to approximately 300 GHz The term substantially is intended to mean largely but not necessarily wholly that which is specified. The term approximately is intended to mean at least close to a given value (e.g., within 10% of). The term generally is intended to mean at least approaching a given state. The term coupled is intended to mean connected, although not necessarily directly, and not necessarily mechanically. The term proximate, as used herein, is intended to mean close, near adjacent and/or coincident; and includes spatial situations where specified functions and/or results (if any) can be carried out and/or achieved. The term distal, as used herein, is intended to mean far, away, spaced apart from and/or non-coincident, and includes spatial situation where specified functions and/or results (if any) can be carried out and/or achieved. The term deploying is intended to mean designing, building, shipping, installing and/or operating.

The terms first or one, and the phrases at least a first or at least one, are intended to mean the singular or the plural unless it is clear from the intrinsic text of this document that it is meant otherwise. The terms second or another, and the phrases at least a second or at least another, are intended to mean the singular or the plural unless it is clear from the intrinsic text of this document that it is meant otherwise. Unless expressly stated to the contrary in the intrinsic text of this document, the term or is intended to mean an inclusive or and not an exclusive or. Specifically, a condition A or B is satisfied by any one of the following: A is true (or present) and B is false (or not present), A is false (or not present) and B is true (or present), and both A and B are true (or present). The terms a and/or an are employed for grammatical style and merely for convenience.

The term plurality is intended to mean two or more than two. The term any is intended to mean all applicable members of a set or at least a subset of all applicable members of the set. The phrase any integer derivable therein is intended to mean an integer between the corresponding numbers recited in the specification. The phrase any range derivable therein is intended to mean any range within such corresponding numbers. The term means, when followed by the term "for" is intended to mean hardware, firmware and/or software for achieving a result. The term step, when followed by the term "for" is intended to mean a (sub)method, (sub)process and/or (sub)routine for achieving the recited result.

The terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. The terms "consisting" (consists, consisted) and/or "composing" (composes, composed) are intended to mean closed language that does not leave the recited method, apparatus or composition to the inclusion of procedures, structure(s) and/or ingredient(s) other than those recited except for ancillaries, adjuncts and/or impurities ordinarily associated therewith. The recital of the term "essentially" along with the term "consisting" (consists, consisted) and/or "composing" (composes, composed), is intended to mean modified close language that leaves the recited method, apparatus and/or composition open only for the inclusion of unspecified procedure(s), structure(s) and/or ingredient(s) which do not materially affect the basic novel characteristics of the recited method, apparatus and/or composition.

Unless otherwise defined, all technical and scientific terms used herein have the same meaning as commonly understood by one of ordinary skill in the art to which this invention belongs. In case of conflict, the present specification, including definitions, will control.

CONCLUSION

The described embodiments and examples are illustrative only and not intended to be limiting. Although embodiments of the invention can be implemented separately, embodiments of the invention may be integrated into the system(s) with which they are associated. All the embodiments of the invention disclosed herein can be made and used without undue experimentation in light of the disclosure. Although the best mode of the invention contemplated by the inventor (s) is disclosed, embodiments of the invention are not limited thereto. Embodiments of the invention are not limited by theoretical statements (if any) recited herein. The individual steps of embodiments of the invention need not be performed in the disclosed manner, or combined in the disclosed sequences, but may be performed in any and all manner and/or combined in any and all sequences. The individual components of embodiments of the invention need not be formed in the disclosed shapes, or combined in the disclosed configurations, but could be provided in any and all shapes, and/or combined in any and all configurations. The individual components need not be fabricated from the disclosed materials, but could be fabricated from any and all suitable materials.

It can be appreciated by those of ordinary skill in the art to which embodiments of the invention pertain that various substitutions, modifications, additions and/or rearrangements of the features of embodiments of the invention may be made without deviating from the spirit and/or scope of the underlying inventive concept. All the disclosed elements and features of each disclosed embodiment can be combined with, or substituted for, the disclosed elements and features of every other disclosed embodiment except where such elements or features are mutually exclusive. The spirit and/or scope of the underlying inventive concept as defined by the appended claims and their equivalents cover all such substitutions, modifications, additions and/or rearrangements.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

REFERENCES

1. G. I. Eskin, "Broad prospects for commercial application of the ultrasonic (cavitation) melt treatment of light alloys," Ultrasonics Sonochemistry 8 (2001) pages 319-325.
2. Charles Vives, "Effects of Forced Electromagnetic Vibration during the Solidification of Aluminum Alloys: Part I. Solidification in the Presence of Crossed Alternating Electric Fields and Stationary Magnetic Fields," Metallurgica and Materials Transactions B, 27B (1996) pages 445-455.

3. Charles Vives, "Effects of Forced Electromagnetic Vibration during the Solidification of Aluminum Alloys: Part II. Solidification in the Presence of Colinear Variable and Stationary Magnetic Fields," Metallurgica and Materials Transactions B, 27B (1996) pages 457-464.
4. O. V. Abramov, "Action of high intensity ultrasound on solidifying metal," Ultrasonics, 25 (1987) pages 73-82.
5. J. Campbell on "Effects of vibration during solidification" International Metals Reviews, 2 (1981) pages 71-108.
6. S. Makarov, R. Ludwig, and D. Apelian, "Resonant oscillation of a liquid metal column driven by electromagnetic Lorentz force sources," J. Acoust. Soc. Am. 105 (1999) 2216-24.
7. G. M. Ludtka, et. al., "In-situ Evidence of Enhanced Phase Transformation Kinetics Due to a High Magnetic Field in a Medium Carbon Steel,", *Scripta Materialia,* 51 (2004) 171-174.
8. R. A. Jaramillo, S. S. Babu, G. M. Ludtka, R. A. Kisner, J. B. Wilgen, G. Mackiewicz-Ludtka, D. M. Nicholson, S. M. Kelly, M. Murugananth, and H. K. D. H. Bhadeshia, "Effect of 30 Tesla Magnetic Field on Transformations in a Novel Bainitic Steel", *Scripta Materialia,* 52 (2005) 461-466.

What is claimed is:

1. A method, comprising:

applying a high magnetic field to at least a portion of a conductive material; and applying an inductive magnetic field to at least a fraction of the conductive material to induce a surface current within the fraction of the conductive material, the surface current generating a substantially bi-directional force that defines a vibration, characterized in that i) the high magnetic field and the inductive magnetic field are substantially confocal, ii) the fraction of the conductive material is located within the portion of the conductive material and iii) ohmic heating from the surface current is ohmically decoupled from the vibration.

2. The method of claim 1, wherein the high magnetic field is externally applied to at least the portion of the conductive material, the inductive magnetic field is externally applying to at least the fraction of the conductive material, and the externally applied inductive magnetic field is substantially immersed within the externally applied high magnetic field.

3. The method of claim 1, wherein the high magnetic field has a magnetic flux density of at least approximately 4 Tesla.

4. The method of claim 1, wherein the high magnetic field includes a substantially homogeneous static high magnetic field.

5. The method of claim 1, wherein the inductive magnetic field is applied at a frequency substantially equal to an electrical resonance of an induction coil and work piece.

6. The method of claim 1, wherein the inductive magnetic field is applied at a frequency substantially equal to an acoustic resonance of a work piece.

7. The method of claim 1, wherein the inductive magnetic field is applied using a modulated carrier waveform.

8. The method of claim 7, wherein a carrier frequency of the modulated carrier waveform is substantially equal to an electrical resonance of an induction coil and a modulation frequency of the modulated carrier waveform is substantially equal to a resonance of a work piece.

9. The method of claim 1, wherein the vibration includes an ultrasonic vibration.

10. The method of claim 1, wherein the vibration causes cavitation within the fraction of the conductive material.

11. The method of claim 1, further comprising continuously casting the conductive material.

12. The method of claim 1, further comprising applying another inductive magnetic field to the conductive material.

13. An apparatus, comprising: a high magnetic field coil defining an applied high magnetic field; an inductive magnetic field coil coupled to the high magnetic field coil, the inductive magnetic field coil defining an applied inductive magnetic field; and a processing zone located within both the applied high magnetic field and the applied inductive magnetic field, characterized in that i) the high magnetic field and the inductive magnetic field are substantially confocal, and ii) ohmic heating of a conductive material located in the processing zone is ohmically decoupled from a vibration of the conductive material.

14. The apparatus of claim 13, wherein the high magnetic field coil defines an externally applied high magnetic field, the inductive magnetic field coil defines an externally applied inductive magnetic field, and the externally applied inductive magnetic field is substantially immersed within the externally applied high magnetic field.

15. The apparatus of claim 13, wherein the applied high magnetic field has a magnetic flux density of at least approximately 4 Tesla.

16. The apparatus of claim 13, wherein the high magnetic field includes a substantially homogeneous static high magnetic field.

17. The apparatus of claim 13, further comprising a conductive electromagnetic barrier located between the high magnetic field coil and the inductive magnetic field coil.

18. The apparatus of claim 13, wherein a conduit is defined between the inductive magnetic field coil and the processing zone.

19. The apparatus of claim 18, wherein a work piece entry opening is located at a first end of the conduit and a work piece exit opening is located at a second end of the conduit.

20. The apparatus of claim 18, wherein a work piece heating system is coupled to the conduit.

21. The apparatus of claim 13, wherein the processing zone includes an ultrasonic processing zone and the vibration of the conductive material includes an ultrasonic vibration.

22. The apparatus of claim 13, further comprising a capacitor coupled to the inductive magnetic field coil; an impedance matching transformer coupled to the capacitor; a linear amplifier coupled to the impedance matching transformer; a modulator coupled to the linear amplifier; a first function generator coupled to the modulator; and a second function generator coupled to the modulator.

23. A continuous caster including the apparatus of claim 13.

24. The apparatus of claim 13, further comprising another inductive magnetic field coil that is coupled to the high magnetic field coil, wherein the another inductive magnetic field coil defines another inductive magnetic field axis that is coincident with the processing container.

25. The apparatus of claim 13, wherein the high magnetic field coil includes a split Helmholtz solenoid magnet assembly and the inductive magnetic field coil includes a planar cylindrical coil.

* * * * *